US005308598A

United States Patent [19]

Coates

[11] Patent Number: 5,308,598

[45] Date of Patent: May 3, 1994

[54] PLEXIFILAMENTARY FIBERS FROM PITCH

[75] Inventor: Don M. Coates, Midlothian, Va.

[73] Assignee: E. I. Du Pont de Nemours and Company, Wilmington, Del.

[21] Appl. No.: 648,767

[22] Filed: Jan. 31, 1991

Related U.S. Application Data

[63] Continuation-in-part of Ser. No. 613,099, Nov. 15, 1990, abandoned, which is a continuation-in-part of Ser. No. 473,683, Feb. 1, 1990, abandoned.

[51] Int. Cl.[5] ..... C01B 31/04; D01F 9/12

[52] U.S. Cl. ..... 423/447.2; 264/29.2; 264/205; 423/447.1; 423/447.4; 423/448

[58] Field of Search ..... 252/182.12; 264/29.2, 264/205, 211.14, DIG. 24; 423/447.1, 447.4, 448, 447.2

[56] References Cited

U.S. PATENT DOCUMENTS 3,081,519 3/1963 Blades et al. ..... 28/81
3,784,679 1/1974 Chiche ..... 423/447.1 X
3,852,428 12/1974 Binder et al. ..... 423/447.1 X
3,915,914 10/1975 Binder et al. ..... 428/489
4,005,183 1/1977 Singer ..... 423/447.2
4,032,430 6/1977 Lewis ..... 264/29.2 X
4,208,267 6/1980 Diefendorf et al. ..... 423/447.1 X

FOREIGN PATENT DOCUMENTS 58-197313 11/1983 Japan .

OTHER PUBLICATIONS

Ultra-High Modulus Polyers, Ciferri et al. Editors, Applied Science Publishers, London, Chapt. 9, "High Modulus Carbon Fibres from Mesophase Pitch" pp. 251-277 (1979).

*Primary Examiner*—Richard D. Lovering

[57] ABSTRACT

A process is provided for flash-spinning plexifilamentary fiber from pitch. The fibers can be stabilized and graphitized. The flash-spinning requires polyethylene amounting to 0.3 to 3.5% of the spin mixture (4 to 20% in the resultant fiber) for satisfactory plexifilament formation.

5 Claims, No Drawings

PLEXIFILAMENTARY FIBERS FROM PITCH

RELATED APPLICATION

This is a continuation-in-part of application Ser. No. 07/613,099, filed Nov. 15, 1990, now abandoned which was a continuation-in-part of application Ser. No. 07/473,683, filed Feb. 1, 1990 now abandoned.

BACKGROUND OF THE INVENTION

1. Field of the Invention

This invention relates to a process for converting pitch into fibers. More particularly the invention concerns a process for flash-spinning pitch into plexifilamentary fibers and the fibers produced thereby. The fibers, particularly those formed from mesophase-forming pitch, are suitable as precursors for "carbon" or "graphite" reinforcing fibers.

2. Description of the Prior Art

Processes for preparing carbon or graphite fibers of very high Young's modulus of elasticity and very high tensile strength are disclosed, for example, by Singer, U.S. Pat. No. 4,005,183, "High Modulus, High Strength Carbon Fibers Produced from Mesophase Pitch", and by Diefendorf et al, U.S. Pat. No. 4,208,267, "Forming Optically Anisotropic Pitches", which disclosures are hereby incorporated by reference. In these known processes the anisotropic or mesophase content of the pitch is increased to a concentration in the range of 40 to well over 90% by a first step in which a coal-tar or petroleum pitch is heat soaked or solvent extracted. Singer discloses heating the starting pitch in an inert atmosphere at temperatures in the range of 350° to 450° C. for a time sufficient to produce a pitch with a mesophase content in the range of 40 to 90%, the lower temperature requiring as much as a week and the higher temperatures, between 1–40 hours. Diefendorf et al discloses washing the starting pitch with solvent (e.g., benzene) and drying the benzene insoluble fraction. After the heat soaking or solvent extraction, fibers are prepared by (a) melting the thusly prepared mesophase pitch at a temperature in the range of about 340° to 380° C., (b) melt spinning, centrifugal spinning or blow spinning the molten pitch into fibers, (c) setting and stabilizing the fibers and (d) then graphitizing the fibers at a temperature in the range of 2,500° to 3,000° C. Generally, the fibers produced from molten pitch by the known processes (i.e., step b above) are very brittle and difficult to handle. Accordingly, it is an object of this invention to provide a process for preparing precursors for stabilization (i.e., step c above) that are less fragile and easier to handle than the precursor fibers of the known processes and to provide carbon fibers having a high surface area for use in absorption and filtration applications.

Techniques for flash-spinning synthetic, crystalline, organic polymers into fibers in the form of plexifilamentary strands are disclosed by Blades et al, U.S. Pat. No. 3,081,519. According to Blades et al, the crystalline polymer is dissolved in an organic solvent and then, at a temperature above the boiling point of the solvent and under at least autogenous pressure, the polymer solution is extruded through an orifice into a region of lower temperature and substantially lower pressure, whereby the solvent flash-evaporates and a plexifilamentary fibrous structure is formed and cooled. Among the many crystalline polymers disclosed as suitable for use in the process are polyethylene, polypropylene, polyhexamethylene adipamide, polycaprolactam, polyethylene terephthalate, etc. Polyhydrocarbons, such as polyethylene and polypropylene, are preferred. However, Blades et al does not disclose flash-spinning of non-crystalline materials, such as pitch, or the making of carbon or graphite fibers.

SUMMARY OF THE INVENTION

The present invention provides a process for preparing fibers from pitch, comprising forming a mixture comprising 7 to 22% by weight of pitch, 0.3 to 5% polyethylene and 74.5 to 92.7% of organic liquid, dispersing and/or dissolving the polyethylene and pitch in the liquid while heating the mixture to a temperature in the range of 130° to 225° C. while under pressure sufficient to prevent boiling, adjusting the pressure to at least 7,000 kPa (1,000 psig) and passing the mixture through an orifice to cause flash-evaporation of the organic liquid and formation of flash-spun fiber comprising at least 4%, but no more than 20%, by weight of polyethylene and 96 to 80% pitch.

In additional embodiments of the invention, the process includes the additional steps of stabilizing the flash-spun fiber and graphitizing the stabilized fiber. Preferably, the pitch amounts to 11 to 21% by weight of the mixture, the pressure is adjusted to a value in the range of 7,500 to 15,000 kPa (1,100 to 2,200 psig), the temperature is in the range of 170° to 200° C., the concentration of polyethylene in the spin mixture is in the range of 0.5 to 2.5%, and the flash-spun pitch fiber comprises 5 to 15% polyethylene.

The present invention also includes a novel flash-spun plexifilamentary fiber comprising 96 to 80% by weight pitch and 4 to 20% polyethylene, preferably having a surface area of at least 1 gram per square meter, and a stabilized and graphitized product made therefrom.

DETAILED DESCRIPTION OF PREFERRED EMBODIMENTS

A wide range of natural or synthetic pitches can be used to form plexifilamentary flash-spun pitch fibers in accordance with the invention. Preferable pitches are graphitizable pitches containing a substantial portion of a solvent-isolatable, mesophase-forming fraction as described in U.S. Pat. No. 4,208,267. Such pitch is referred to herein as a "mesophase-forming pitch". The mesophase is a highly oriented, optically anisotropic phase. A particularly useful mesophase-forming pitch is commercially available Ashland 240. Its use is illustrated in the examples below.

A wide range of organic liquids is suitable for use in the process of the present invention. Such liquids usually can dissolve linear polyethylene at a temperature in the range of 130° to 210° C. under autogenous pressure to the extent that the solution contains at least 10% by weight of dissolved polyethylene. Among such organic liquids are aliphatic and aromatic hydrocarbons, such as pentane, hexane, heptane, cyclopentane, cyclohexane, benzene, toluene, etc. and some halogenated hydrocarbons, such as methylene chloride and trichlorofluoromethane. Particularly preferred for use in the process of the present invention are methylene chloride and mixtures of methylene chloride and trichlorofluoromethane.

The term "polyethylene", as used herein, is intended to embrace not only homopolymers of ethylene, but also copolymers wherein at least 85% of the recurring units are ethylene units. The preferred polyethylene is a homopolymeric linear polyethylene having an upper limit of melting range of about 130° to 135° C., a density in the range of 0.94 to 0.98 g/cm$^3$ and a melt index (as defined in ASTM D 1238-57T, Condition E) in the range of 0.1 to 6.0.

In accordance with the present invention, pitch is flash-spun into a fibrillated plexifilamentary fiber. A plexifilament, as is known and described, for example by Blades et al, U.S. Pat. No. 3,081,519, is a strand composed of a three dimensional network of film fibril elements which are connected at tie points along and across the strand.

The process for preparing plexifilamentary pitch fibers in accordance with the present invention comprises forming a well-dispersed, heated spin mixture comprising (a) 7 to 22% pitch, preferably mesophase-forming pitch, (b) at least 0.3% and usually no more than 3.5%, preferably 0.5 to 2.5% polyethylene, and (c) 74.5 to 92.7% of organic liquid. The present inventor found that when the polyethylene content of the resultant flash-spun structure was less than about 4 weight percent, the structure was a dust and that when the polyethylene concentration in the product was greater than 20%, when a fiber was obtained, it was poorly fibrillated and very weak. The best plexifilamentary pitch structures were obtained when the polyethylene content of the structure was in the range of about 5 to 15 weight percent.

The plexifilamentary pitch fibers produced by the process have high specific surface area, usually at least 1 m$^2$/g, and are suitable for use in filter beds, as insulation and/or as oil absorbers. If made from mesophase-forming pitch, the fibers are also suitable precursors for the formation of carbon or graphite fibers of high strength.

The temperatures required for preparing and flash-spinning the mixture of pitch, polyethylene and organic liquid are usually in the range of 130° to 225° C., preferably 170° to 200° C. The thorough mixing and flash-spinning are performed at a pressure that is higher than the autogenous pressure of the mixture. Usually the pressure is greater than 1,000 psig (7,000 kiloPascals). Preferably the pressure is in the range of about of 7,500 to 15,000 kPa (1,100 to 2,200 psig).

The heated spin mixture is thoroughly mixed and then flash-spun by being passed through an orifice assembly, preferably of the kind that contains a let-down chamber, as disclosed for example in Smith, U.S. Pat. No. 3,483,899 (particularly FIG. 5), and Marshall, U.S. Pat. No. 4,352,650 (particularly FIG. 2), which disclosures are hereby incorporated herein by reference. The spin mixture is flash-spun into a region of much lower temperature and pressure (usually ordinary room temperature and pressure) than exists upstream of the spin orifice. As a result, the organic liquid is flash evaporated and a plexifilamentary pitch strand is formed. Substantially continuous strands are preferred, though shorter lengths are also encompassed by the invention. The plexifilamentary nature of the strand is readily observable by the unaided eye or by optical and/or electron microscope inspection. Usually, room temperature and pressure are employed in the low temperature and pressure region of strand formation.

After flash-spinning, the fibers optionally are processed further by a stabilization treatment and then optionally by a graphitization treatment. Conventional methods can be used for each of these steps. For example, stabilization may be effected by further heat treatment at about 300° to 390° C. for from 5 to 60 minutes, as disclosed in Singer, U.S. Pat. No. 4,005,183. Alternatively, a nitric acid treatment, such as the one illustrated in the Example 1 below, can be used for stabilization. The stabilized fibers can be graphitized by conventional techniques, such as heating in an inert atmosphere at temperatures in the range of 2,500° to 3,000° C., as disclosed, for example also in Singer, U.S. Pat. No. 4,005,183, which disclosure is hereby incorporated herein by reference. Such stabilization and graphitization completely remove the polyethylene from the pitch of the flash-spun plexifilamentary strand.

After the flash-spinning step, the as-spun pitch or pitch fibers of the invention are not brittle and can be handled quite readily. Preferred flash-spun fiber of the invention can be formed into a loop and can be gently tied into a knot.

The as-spun fiber produced in accordance with the invention is a fibrillated plexifilamentary strand having a surface area of at least 1.0 m$^2$/g, as measured with a Stohlein instrument by the BET method of Brunauer et al, *J. Am. Chem. Soc.*, v. 60, pp. 309–319 (1938).

The examples below are included for the purpose of illustrating the invention, but are not intended to limit its scope, which is defined by the appended claims.

EXAMPLES

In each of the following examples, substantially the same equipment and procedures were employed to prepare samples of flash-spun pitch. A pressure vessel of 21-liter (5-gallon) internal volume and about 30-cm (1-foot) diameter was equipped with an efficient mixing stirrer, temperature and pressure measuring means, heating means and an inlet for pressurizing the contents of the vessel with inert nitrogen gas. An outlet line at the bottom of the vessel was connected to a quick-opening valve which, in turn was connected to a spin assembly of the type shown in FIGS. 2 and 3 of Marshall, U.S. Pat. No. 4,352,650, which disclosure is hereby incorporated herein by reference. Means were included for uniformly heating the vessel, the lines leading to the valve, the valve and the spin assembly. Dimensions of the spin assembly were as follows:

Cylindrical letdown chamber

Inlet diameter = 0.183 cm (0.072 in)

Length = 13.3 cm (5.25 in)

Diameter = 1.9 cm (0.75 in)

Inlet and outlet flare angle = 80 degrees

Spin Orifice Diameter = 0.163 cm (0.064 in)

Tunnel

Inlet diameter = 0.84 cm (0.33 in)

Outlet diameter = 1.14 cm (0.45 in)

Length = 0.70 cm (0.275 in)

For each example, the vessel was loaded with the spin mix ingredients, the vessel was closed, heated to 180° C., and stirred thoroughly for 1.5 hours. The valve, lines and spin assembly were all heated to the same temperature. The pressure in the heated vessel was adjusted to 9,650 kiloPascals (1,400 psig), except for Example 1, in which the pressure was adjusted to 8,300 kPa (1,200 psig). Upon stopping the stirring, the quick-opening valve was opened and the spin mixture was permitted to pass through the valve and spin assembly. The resultant product and gas were collected in a large, Plexiglas enclosure, which was approximately at room conditions of about 20° C. and 1 atmosphere.

Unless indicated otherwise, all percentages are by total weight of the spin mix or of the flash-spun fiber. Samples designated with Arabic numerals are samples of the invention. Sample A is a comparison sample outside the invention. Examples 1-3 illustrate flash-spinning in accordance with the invention of a heat soaked Ashland 240 (Ashland Oil Co.). The pitch was heat soaked in two stages. The first stage consisted of heating at 360° C. under a vacuum of about 29 in. Hg; the second stage consisted of heating at 390° C. The total heating time was about 12 hours. The resulting heat soaked pitch was produced in 75% yield. This pitch is isotropic, but contains about 30% of a solvent-isolatable fraction that becomes mesophase on fusion. Examples 4-6 illustrate flash-spinning in accordance with the invention of the same type of pitch that had not been heat-soaked. Summary Tables I and II below list the ingredients and concentrations used in each Example.

EXAMPLES 1-3

These examples illustrate the flash-spinning of pitch into plexifilamentary fibers in accordance with the invention. The steps of stabilizing and graphitizing some of the fibers are also illustrated. Details of the flash-spinning are summarized in Table I.

TABLE I

| | Examples 1-3 | | |
|---|---|---|---|
| Example Number | 1 | 2 | 3 |
| Sample Identification | 1 | 2 | 3 |
| Spin Mix Ingredients, grams | | | |
| Pitch[1] | 3.755 | 2.286 | 2.286 |
| Polyethylene[2] | 417 | 254 | 172 |
| Methylene chloride | 14.360 | 16.000 | 860 |
| Trichlorofluoromethane[3] | 0 | 0 | 16.346 |
| As % of Mix | | | |
| Solids | 22.5 | 13.7 | 12.5 |
| Pitch | 20.25 | 12.3 | 11.62 |
| Polyethylene | 2.25 | 1.4 | 0.88 |
| Organic Liquid | 77.5 | 86.3 | 87.5 |
| Methylene chloride | 77.5 | 86.3 | 4.4 |
| Trichlorofluoromethane | 0.0 | 0.0 | 83.1 |
| As % of Solids | | | |
| Pitch | 90.0 | 90.0 | 93.0 |
| Polyethylene | 10.0 | 10.0 | 7.0 |

Notes
[1]Ashland 240 commercial pitch.
[2]Alathon ® 7026A, made by E.I. dup Pont de Nemours & Co.
[3]Freon ® -11, made by E.I. du Pont de Nemours & Co.

The flash-spinning of each of the spin mixes of Examples 1-3 yielded product that was a substantially continuous plexifilamentary strand of pitch. The surface area of the flash-spun pitch strand of Example 1 has a surface area (by the BET method) of 1.6 square meters per gram. Compared to conventional melt-formed mesophase pitch fibers, the flash-spun fibers of this example were considerably less brittle and much easier to handle.

The flash-spun pitch fibers of Example 1 were further processed through stabilization and graphitization treatments that removed the polyethylene from the structure and converted the pitch into graphite. The flash-spun fiber was stabilized by (1) heating at 85° C. for about 5 minutes a stirred mixture of 200 grams of the flash-spun pitch fiber, 180 grams of concentrated nitric acid and 420 grams of water, (2) removing the fiber from the mixture and washing it in flowing water, (3) draining the water from the fiber and (4) drying the fiber in a hot air oven at 65° C. A lit match was then held to the dried fiber. No melting was observed; this indicated that the fiber had been stabilized. The thusly stabilized fiber was then graphitized by being compressed into a pellet and heated at 2,800° C. in an induction-heating furnace. The resultant pellet exhibited a shiny black metal-like appearance.

EXAMPLES 4-6 AND COMPARISON A

Examples 4-6 and Comparison A demonstrate the importance of including polyethylene in the spin mix so that satisfactory plexifilamentary pitch fibers can be produced. Although the Ashland 240 pitch that was used in these three Examples and comparison was not heat-soaked and therefore had an even lower amount of a solvent-isolatable, mesophase-forming fraction, than the pitch employed in Examples 1-3, the flash-spinning results from both sets of Examples of the invention correlated well with each other and showed the necessity for no less than about 4 percent and no more than about 20% of polyethylene in the spin mix, if satisfactory plexifilamentary strands were to be produced. The various concentrations of ingredients used in these examples and comparison are summarized in Table II below.

TABLE II

| | | Examples 4-6 | | |
|---|---|---|---|---|
| Example No. | — | 4 | 5 | 6 |
| Sample | A | 4 | 5 | 6 |
| Spin Mix, grams | | | | |
| Pitch | 2.500 | 2,400 | 2.285 | 2,080 |
| Polyethylene | 0 | 100 | 172 | 520 |
| $CH_2Cl_2$ | 860 | 860 | 860 | 3,640 |
| $CCl_3F$ | 16.346 | 16.346 | 16.346 | 14,568 |
| As % of Mix | | | | |
| Solids | 12.7 | 12.7 | 12.5 | 12.5 |
| Pitch | 12.7 | 12.2 | 11.6 | 10.0 |
| Polyethylene | 0.0 | 0.5 | 0.9 | 2.5 |
| Organic Liquid | 87.3 | 87.3 | 87.5 | 87.5 |
| $CH_2Cl_2$ | 4.4 | 4.4 | 4.4 | 17.5 |
| $CCl_3F$ | 82.9 | 82.9 | 83.1 | 70.0 |
| As % of Solids | | | | |
| Pitch | 100.0 | 96.0 | 93.0 | 80.0 |
| Polyethylene | 0.0 | 4.0 | 7.0 | 20.0 |

Note
The polyethylene and solvents are the same as were used in Examples 1-3, see Table I. Notes.

The following results were obtained. When the spin mix included no polyethylene, (Comparison A), the flash-spun product was a coarse dust. Flash-spun product of Example 4, which contained 4% polyethylene and 96% pitch, was finely fibrillated but somewhat weak and discontinuous. Continuous, plexifilamentary strands of 7/93 and 10/90 polyethylene/pitch were produced in Examples 1–3 and 5. The product of Example 6, which was a 20/80 polyethylene/pitch plexifilament, was coarse and poorly fibrillated in comparison to the flash-spun products of Examples 1–3 and 5. These results show that for satisfactory pitch plexifilaments in accordance with the invention, the spin mix must provide at least 4%, but no more than 20% (preferably 5 to 15%) of polyethylene to the flash-spun fibers.

I claim:

1. A process for preparing fibers from pitch comprising forming a mixture comprising 7 to 22% by weight pitch, 0.3 to 3.5% polyethylene and 74.5 to 92.7% of organic liquid, dispersing the polyethylene and pitch in the organic liquid, heating the dispersed mixture to a temperature in the range of 130° to 225° C. while under pressure sufficient to prevent boiling, adjusting the pressure to at least 7,000 kPa and passing the mixture through an orifice into a region of lower temperature and much lower pressure to cause flash-evaporation of the solvent and formation of a flash-spun plexifilamentary fiber comprising at least 4 and no more than 20% by weight of polyethylene and 96 to 80% pitch.

2. A process in accordance with claim 1 wherein the pitch is a mesophase-forming pitch which amounts to 11 to 21% by weight of the mixture, the pressure is adjusted to a value in the range of 8,000 to 15,000 kPa, the temperature is in the range of 170° to 200° C., and the flash-spun fiber comprises 5 to 15% polyethylene.

3. A process in accordance with claim 1 wherein the organic liquid is methylene chloride or a mixture of trichlorofluoromethane and methylene chloride.

4. A process in accordance with claim 1, 2 or 3 wherein the flash-spun pitch fiber is stabilized and graphitized.

5. A graphitized flash-spun plexifilamentary fiber.

* * * * *